United States Patent [19]

Chang

[11] 4,381,337

[45] Apr. 26, 1983

[54] POLYESTER ADHESIVE LAYER FOR PHOTOSENSITIVE ELEMENTS

[75] Inventor: Mike S. H. Chang, Danbury, Conn.

[73] Assignee: Pitney Bowes Inc., Stamford, Conn.

[21] Appl. No.: 324,164

[22] Filed: Nov. 23, 1981

[51] Int. Cl.[3] ..... G03G 5/14; G03G 5/04

[52] U.S. Cl. ..... 430/58; 430/59; 430/60; 525/444

[58] Field of Search ..... 430/56, 59, 131, 134, 430/60; 525/444

[56] References Cited

U.S. PATENT DOCUMENTS

| | | | |
|---|---|---|---|
| 3,615,415 | 10/1971 | Gramza | 430/134 |
| 3,824,099 | 7/1974 | Champ et al. | 430/70 X |
| 4,150,987 | 4/1979 | Anderson et al. | 430/77 |
| 4,275,133 | 6/1981 | Chu et al. | 430/59 X |

FOREIGN PATENT DOCUMENTS

| | | | |
|---|---|---|---|
| 2426075 | 1/1980 | France | 525/444 |

*Primary Examiner*—Roland E. Martin, Jr.

*Attorney, Agent, or Firm*—Melvin J. Scolnick; Albert W. Scribner; William D. Soltow, Jr.

[57] ABSTRACT

Organic photoconductive elements with a charge generating layer and a charge transport layer carried on an electroconductive support are disclosed. The invention involves the combined use of a mixture of a polyester having a Tg (glass transition temperature) larger than about 60° C. with a polyester having a Tg smaller than about 30° C. in the adhesive bonding layer on the electroconductive support and in the charge transporting layer to provide a receptive and retentive base layer for the charge-generating layer.

6 Claims, No Drawings

POLYESTER ADHESIVE LAYER FOR PHOTOSENSITIVE ELEMENTS

BACKGROUND OF THE INVENTION

The present invention relates to the field of electrophotographic reproduction and, more particularly, to dual layer organic photoconductive elements such as belts, drums, webs, or the like, which are used in machines such as copying machines. Reference is made to U.S. Pat. Nos. 3,615,415, 3,824,099 and 4,150,987 for their discussion of the general field of the present invention and for their disclosure of some of the specific materials and procedures over which the present invention represents an improvement.

Aforementioned U.S. Pat. Nos. 3,824,099 and 4,150,987 relate to dual layer organic photoconductive elements comprising a conductive substrate such as a paper, metallized plastic film or metal plate, supporting two basic layers, namely a charge generating layer and a charge transport layer. Either layer may be adjacent the conductive substrate, and an adhesive bonding layer may be applied to bond the charge generating layer to the electroconductive support.

During use, the photoconductive element is charged, exposed to light passed through or reflected by the light-transmissive areas of an imaged original sheet to conduct away the charge in the exposed areas, and the charge retaining or unexposed areas are either "inked" with toner which is transferred to a copy sheet or are first transferred to a copy sheet and then "inked" with toner thereon. The toner is fused on the copy sheet to form fixed images corresponding to the images present on the original sheet.

Dual layer organic photoconductive elements were developed in order to provide extremely fast response to light exposure within the visible range of the spectrum. Preferred materials in this respect are Chlorodiane Blue as the charge generating organic chemical of the charge generating layer and p-type hydrazones or triaryl pyrazolines as the organic chemicals of the charge transport layer.

Chlorodiane Blue is a preferred charge generating material because it has good stability and provides photoconductive elements having a desired shelf life or duration of storage prior to breakdown and deterioration or loss of the charge generating properties. Chlorodiane Blue also has a superior light sensitivity and charge generating properties over a broad portion of the visible light range, i.e., between 400 mu and 700 mu.

Charge generating layers based upon Chlorodiane Blue dye or other known charge generating organic chemicals are thin layers which contain the dye in solid particulate form and which therefore are relatively brittle and have low cohesive and adhesive strength.

In order to provide a bond between the charge generating layer and the conductive support, e.g., commonly a metallized plastic film such as aluminized polyester available from the duPont Company under the trademark Mylar, it is known from Example I of U.S. Pat. No. 4,150,987 to apply a bonding layer of synthetic thermoplastic resin such as a linear polyester resin having a glass transition temperature (Tg) larger than 60° to the conductive support. U.S. Pat. No. 4,150,987 also discloses that the use of other known constituents may be included in the charge transport layer for enhanced adhesion.

We have discovered that known organic photoconductive elements, such as the elements described in the example given above, are still susceptible to delamination and having the problem of brittleness, especially after long term storage, whereby the bond between the charge generating layer and the electroconductive support becomes relatively easy to break down and the charge generating layer and charge transport layer also become relatively easy to peel or flake from the support to render the electroconductive element less desirable for its intended purpose.

Solutions to these types of problems are described in commonly assigned and copending U.S. patent application Ser. Nos. 214,362, filed Dec. 8, 1980, for "Photosensitive Elements and Process" by Chang et al, now abandoned, and 296,667, filed Aug. 26, 1981 for "Photosensitive Elements and Process" by Chang et al.

SUMMARY OF THE INVENTION

The novel dual-layer photoconductive elements of the present invention were developed in order to provide photoconductive elements which have the known response advantages of dual-layer elements, particularly those based upon Chlorodiane Blue in the charge generating layer, and which are substantially strong and resistant to delamination and flaking or peeling of the photosensitive layers from a flexible electroconductive support such as a metallized plastic film.

The present invention is based upon the discovery that the combined use of a material comprising a mixture of a first polyester having a glass transition temperature (hereinafter referred to as Tg) larger than about 60° C. and a second polyester having a Tg smaller than about 30° C., the first polyester varying from about 40 to 70 weight percent of the total mixture and the second polyester varying from about 30 to 60 weight percent of the total mixture as the adhesive layer used for bonding the charge generating and transport layers to the support and the addition of this material as the binder for the charge transport layer, provides an unexpectedly strong bond between particulate charge generating chemicals responsive to actinic radiation to generate an electron-hole pair, a flexible support such as a metallized plastic film and a resin-containing charge transfer supercoat.

DESCRIPTION OF THE PREFERRED EMBODIMENTS

In accordance with the present invention I have found that by the combined application of a mixture of a polyester having a glass transition temperature (hereinafter Tg) greater than about 60° C. and a polyester having a Tg less than about 30° C. in both the adhesive layer and charge transport layer of an organic photoconductor having a charge generating layer and a charge transport layer on an electroconductive support, the adhesion of the photoreceptor thereby prepared is substantially improved. There are several polyesters that are particularly suitable for use according to the present invention from which polyesters having a Tg greater than about 60° C. and those having a Tg less than about 30° C. can be selected. Examples of these polyesters include poly (ethylene terephthalate), poly (oxycarbonylethylene), poly (oxcarbonylpropylene), poly (oxycarbonyl-1, 4 cyclohexylenecarbonyloxyoctamethylene)-cis and trans, poly (oxycarbonyl-1-vinylethylene), poly (oxyfumaroyloxyhexamethylene), poly (oxyglutaryloxyhexamethylene), poly (oxyhexamethyleneoxy-α, α'-dibutylsebacoyl), poly (oxyhexamethylenoxysebacoyl), poly (oxyisophthaloyloxy-4, 4'-biphenylene), poly (oxymaleoyloxyhexamethylene), poly (oxyoxalyloxyethylene), poly (oxyoxalyloxyhexamethylene), poly (oxy-1, 4-phenyleneoxyisophthaloyl), poly (oxysebacoyloxyhexadecamethylene), poly (oxysuccinyloxyhexamethylene), and poly (oxyundecanoyl). Some specific examples of the types of commercially available polyester resins (i) having a Tg larger than about 60° C. that can be used in the practice of the present invention include polyester resins such as Vitel PE200 and Vitel PE100 (Goodyear Chemical Co.) and (ii) having a Tg smaller than about 30° C.that can be used in the practice of the present invention include polyester resins such as Vitel PE307 and Vitel PE55-71A (Goodyear Chemical Co.).

Generally, it is preferred in accordance with the present invention that the mixture of the two polyester resins include from about 40 to 70 percent by weight of the total mixture of a first polyester having a Tg larger than about 60° C. and from about 30 to 60 percent by weight of the total mixture of the second polyester having a Tg smaller than about 30° C. I have found that one of the most preferable mixtures is one containing about a 50 percent to 50 percent weight ratio of the two polyesters.

When a mixture of polyesters is used as the adhesive layer it is preferred in accordance with the present invention that the polyester mixture be substantially all that is required for the adhesive layer and therefore it should not be necessary to include any other polymeric resins as a base for the adhesive layer. However, minor amounts of other ingredients such as resins, dyes, or the like, can be present provided that such additives do not interfere with or diminish the photosensitive or charge generating properties of the active organic chemical, such as Chlorodiane Blue. Generally, it is preferred that the polyester mixture added to the charge transport layer be added in an amount varying from about 10 to about 50 weight percent based upon the weight of the charge transport layer, and most preferably from about 15 to about 25 percent.

The improved photoreceptor in accordance with the present invention is particularly effective for the production of dual-layer photoconductive elements having a metallized or otherwise-conductive plastic film foundation or support. A preferred support in the field of dual-layer photoconductive elements is aluminized polyethylene terephthlate film available under the trademark Mylar. However, plastic films have poor receptivity or retentivity with respect to the conventional particulate or powdery coatings of organic charge generating chemicals such as Chlorodiane Blue and squarylium dyes or mixtures thereof. While the application of the resinous supercoating containing the organic charge transfer chemical over the charge generating layer improves the bond between the latter and the film foundation, and the application of an undercoating or bonding layer, such as a single linear polyester, provides a further improvement in the bond to the film foundation, nevertheless the resultant bond is unsatisfactory since delamination, flaking and/or peeling of the coating(s) from the film can result from handling or repeated use of the photoconductive element, particularly after a long term storage of the photoreceptor.

Reference is again made to U.S. Pat. No. 4,150,987 which discloses the use of an adhesive undercoating or bonding layer of linear polyester resin between a conductive film support and a charge generating layer of an organic chemical such as Chlorodiane Blue. Reference is also made to this patent and to U.S. Pat. No. 3,824,099 for their disclosure of some suitable charge transport organic chemicals such as p-type hydrazones and triaryl pyrazolines and charge transport layers containing such chemicals and the organic binders used therewith.

The following Example is given as an illustration of a preferred embodiment of the present invention and should not be considered limitative.

EXAMPLE

The general procedure described in Example 1 of U.S. Pat. No. 4,150,987 was followed to produce a three-layered organic photoconductive element according to the invention of said Patent. Said element was used as a control for comparison purposes to demonstrate the improved results made possible by the present invention. The general procedure of the Example was repeated except in accordance with the present invention a mixture of Vitel PE200 and Vitel PE307 (Goodyear Chemical Co.) at a 50-50 weight ratio was used to replace the Vitel PE200. This mixture was added as the adhesive layer and was added to the charge transporting layer (approximately 16 percent by weight of the charge transport layer).

Each layer of coating after being meniscus coated was dried by being exposed to infrared radiation and then placed in a forced air oven at 250° F. The exposure period (minutes) for each layer is summarized below:

| Layer | IR (Min.) | Oven (Min.) |
|---|---|---|
| Adhesive Layer | 4 | 2 |
| Charge Generating Layer | 4 | 3 |
| Charge Transport Layer | 4 | 2-3 |

Generally, the coating weight of the adhesive layer was about 13–15 mg/ft$^2$; charge generating layer (Chlorodiane Blue) about 16–20 mg/ft$^2$; and the charge transport layer (hydrazone) about 1.6–2.1 gm/ft$^2$.

Photoconductive elements prepared in accordance with Example I of U.S. Pat. No. 4,150,987 (control sample) and in accordance with the present invention, were tested by subjecting both types of elements to use in an electrophotographic process six months after the coating processes. Although both photoconductive elements exhibited substantially identical photoresponse properties, the adhesion properties of the control sample was rated as a "Failure" while that of the samples prepared in accordance with the present invention was rated "Pass" based on subjecting these samples to a critical adhesion test as described below:

Critical Adhesion Test

The organic layered photoconductor is folded 180° with the photoconductor coating facing inward. A force is applied along the folding edge just sufficient in magnitude to creep the Mylar substrate. If the coating becomes delaminated or falls apart due to this action, the adhesion of the coating is rated as a "Failure"; if it is intact, i.e., essentially no delamination or falling apart, it is rated as a "Pass."

Variation and modifications of the present invention will be apparent to those skilled in the art in the light of the present disclosure and within the scope of the present claims.

I claim:

1. An organic photoconductive element comprising an electroconductive plastic film support, a bonding layer of an adhesive material on said support, a charge generating layer comprising a particulate charge generating organic chemical adhered to said bonding layer, and a charge transport layer comprising a charge transport organic chemical and a binder material for the charge transport chemical adhered to said charge generating layer, characterized by said adhesive bonding layer and said binder material comprising a mixture of a first polyester having a Tg larger than about 60° C. and a second polyester having a Tg smaller than about 30° C., the amount of the first polyester varying from about 40 to about 70 weight percent of the total mixture and the amount of the second polyester varying from about 30 to about 60 weight percent of the total mixture.

2. An organic photoconductive element according to claim 1 wherein said mixture comprises said first and second polyesters in a 50-50 percent weight ratio.

3. An organic photoconductive element according to claim 1 wherein said first and second polyesters are selected from the group consisting of poly (ethylene terephthalate), poly (oxycarbonylethylene), poly (oxcarbonylpropylene), poly (oxycarbonyl-1, 4-cyclohexylenecarbonyloxyoctamethylene)-cis and trans, poly (oxycarbonyl-1-vinylethylene), poly (oxyfumaroyloxyhexamethylene), poly (oxyglutaryloxyhexamethylene), poly (oxyhexamethyleneoxy-$\alpha$, $\alpha'$-dibutylsebacoyl), poly (oxyhexamethylenoxysebacoyl), poly (oxyisophthaloyloxy-4, 4'-biphenylene), poly (oxymaleoyloxy-hexamethylene), poly (oxyoxalyloxyethylene), poly (oxyoxalyloxyhexamethylene), poly (oxy-1, 4-phenyleneoxyisophthaloyl), poly (oxysebacoyloxyhexadecamethylene), poly (oxysuccinyloxyhexamethylene), and poly (oxyundecanoyl).

4. An organic photoconductive element according to claim 1 wherein said charge transport layer contains said polyester mixture in an amount from about 10 to about 50 weight percent based upon the weight of the charge transport layer.

5. An organic photoconductive element according to claim 4 wherein said charge transport layer contains said polyester mixture in an amount from about 15 to about 25 weight percent based upon the weight of the charge transport layer.

6. An organic photoconductive element according to claim 1 wherein said charge generating organic chemical comprises Chlorodiane Blue.

* * * * *